United States Patent [19]

Nakamura

[11] Patent Number: 4,647,092

[45] Date of Patent: Mar. 3, 1987

[54] DOOR LATCH DEVICE

[75] Inventor: Hitoshi Nakamura, Yokohama, Japan

[73] Assignee: Ohi Seisakusho Co., Ltd., Yokohama, Japan

[21] Appl. No.: 716,641

[22] Filed: Mar. 27, 1985

[30] Foreign Application Priority Data

Mar. 30, 1984 [JP] Japan ..... 59-64886

[51] Int. Cl.[4] ..... E05C 3/26

[52] U.S. Cl. ..... 292/216; 292/337

[58] Field of Search ..... 292/216, 218, 337, DIG. 53

[56] References Cited

U.S. PATENT DOCUMENTS 3,528,694 9/1970 Harley ..... 292/216
3,848,909 11/1974 Foley ..... 292/216
4,468,059 8/1984 Nelson et al. ..... 292/337

FOREIGN PATENT DOCUMENTS 8304354 7/1983 Fed. Rep. of Germany .

*Primary Examiner*—Richard E. Moore
*Attorney, Agent, or Firm*—Schwartz, Jeffery, Schwaab, Mack, Blumenthal & Evans

[57] ABSTRACT

Herein disclosed is an improved door latch device which is designed for facilitating not only the assembly per se but also the mounting thereof to a door. The door latch device comprises a generally L-shaped base plate with first and second wing portions, a latch mechanism section secured to the first wing portion, a control mechanism section which exhibits its normal function when properly mounted to the second wing portion, a hinge structure for pivotally connecting the latch and control mechanism sections together and disconnecting them from each other when desired, and a snap fastening device for detachably fastening the control mechanism section to the second wing portion in a snap action manner.

27 Claims, 22 Drawing Figures

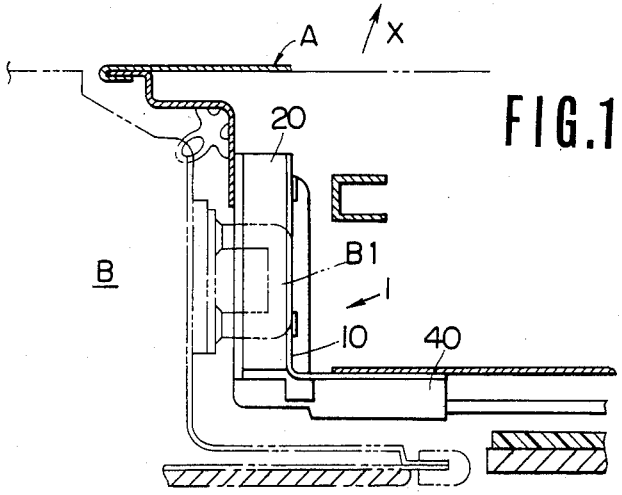
FIG.1
FIG.2
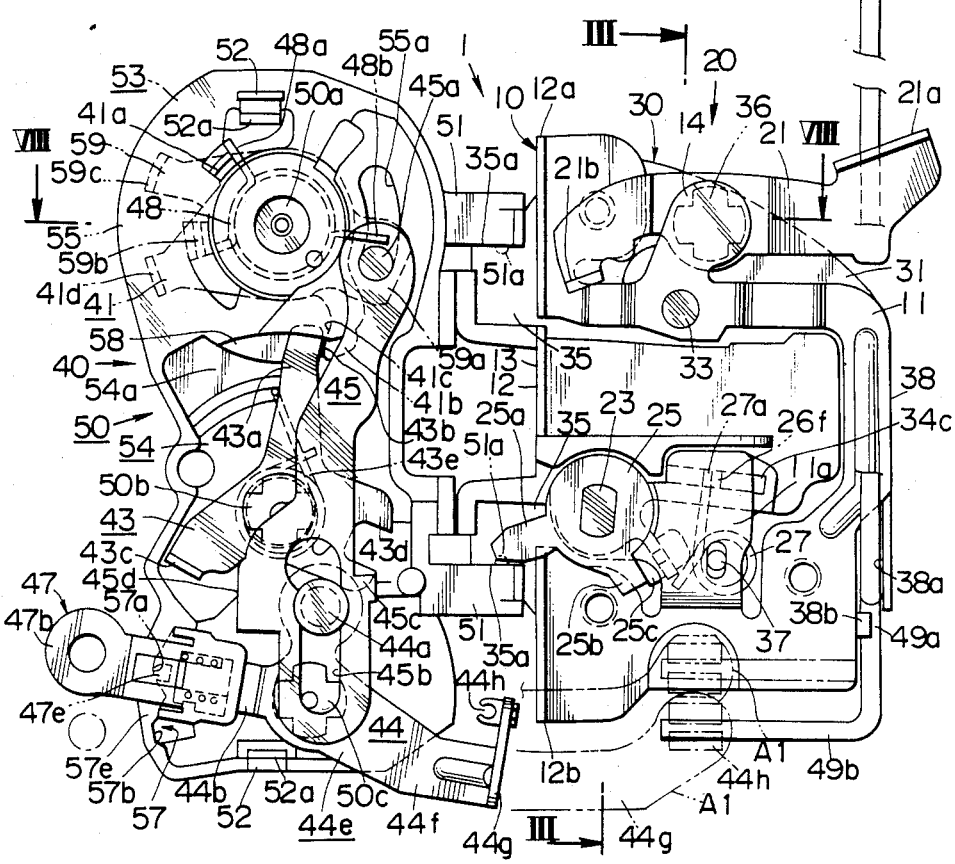

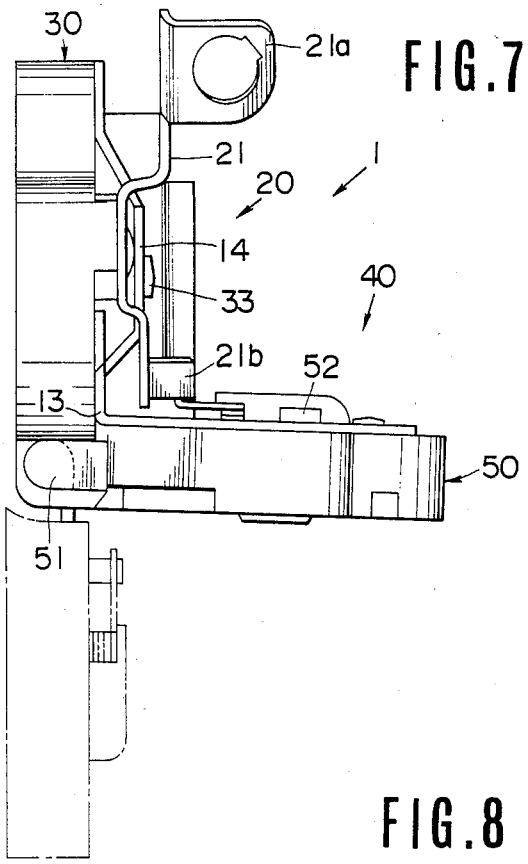
FIG.7
FIG.8
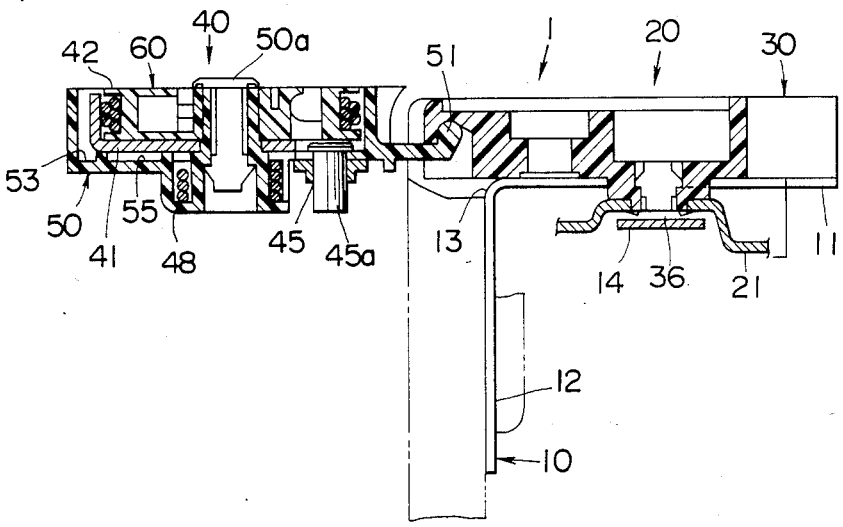

FIG.11
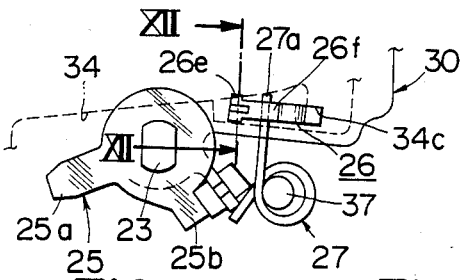
FIG.12
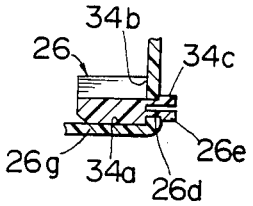
FIG.13A
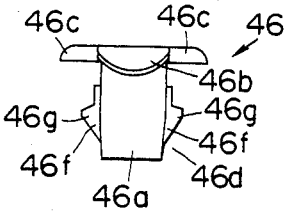
FIG.13B
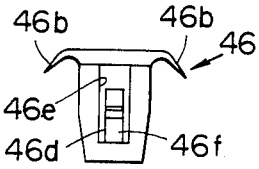
FIG.13C
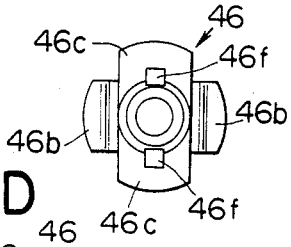
FIG.13D
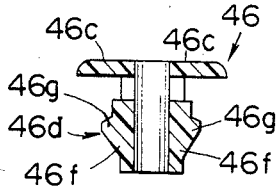
FIG.14A
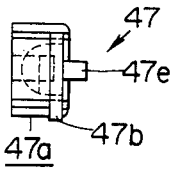
FIG.14B
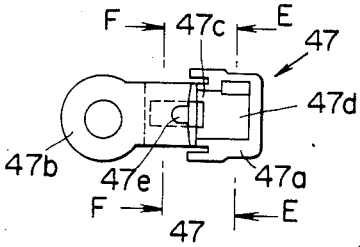
FIG.14C
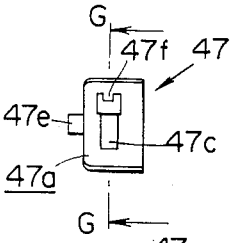
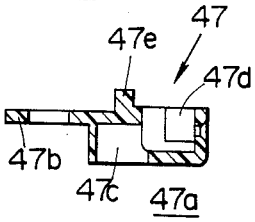
FIG.14D
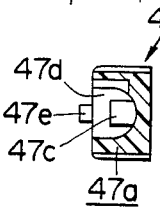
FIG.14E
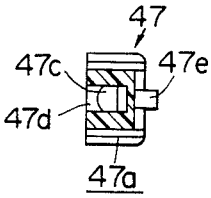
FIG.14F
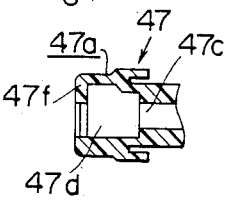
FIG.14G

DOOR LATCH DEVICE

BACKGROUND OF THE INVENTION

The present invention relates in general to a door latch device for latching a door to a fixed body to which the door is operatively connected, and more particularly to a latch device of an automobile door, which is designed to facilitate not only the assembly per se, but also the mounting thereof to the door.

DESCRIPTION OF THE PRIOR ART

For latching a hinged door to a fixed body, various kinds of latch devices have been proposed and put into practical use. Some of them are of a type in which a generally L-shaped base plate is used for compactly mounting thereon the parts of the device. However, some of the devices of this type have been designed without considering adaptability to mass production. That is, in those devices, the parts on the base plate are arranged non-systematically inducing difficulty of adoption of automatic assembling machines.

SUMMARY OF THE INVENTION

It is therefore an object of the present invention to provide an improved door latch device which is designed to facilitate not only the assembly per se but also the mounting thereof to the door.

According to the present invention, there is provided a door latch device which comprises a generally L-shaped base plate having first and second wing portions, a latch mechanism section secured to the first wing portion and having a function to latch a striker when the same is brought into engagement therewith, a control mechanism section having a function to control the operation of the latch mechanism section and exhibiting its normal function thereof when properly mounted to the second wing portion of the base plate, hinge means for pivotally connecting the latch and control mechanism sections together and disconnecting them from each other when desired, and snap fastening means for detachably fastening the control mechanism section to the second wing portion of the base plate in a snap action manner.

BRIEF DESCRIPTION OF THE DRAWINGS

Other objects and advantages of the present invention will become apparent from the following description when taken in conjunction with the accompanying drawings, in which:

FIG. 1 is a horizontally sectional view of an automotive door in a closed condition at the position where a door latch device according to the present invention is mounted;

FIGS. 2 to 9 are views showing the door latch device of the present invention in latched but unlocked condition, in which:

FIG. 2 is a front view of the door latch device with a latch mechanism section and a control mechanism section thereof being unfolded, FIG. 3 is a sectional view taken along the line III—III of FIG. 2, FIG. 4 is a back view of the door latch device with the latch and control mechanism sections being unfolded, FIG. 5 is a front view of the door latch device in a properly assembled condition, FIG. 6 is a sectional view taken along the line VI—VI of FIG. 5, FIG. 7 is a plan view of the door latch device of the invention in a properly assembled condition, FIG. 8 is a sectional view taken along the line VIII—VIII of FIG. 2, and FIG. 9 is a back view of the door latch device similar to FIG. 4 but with some parts removed for clarification of parts arranged therein.

FIG. 11 is a front but partial view of the assembled door latch device of the invention at the position where the wedge member is located;

FIG. 12 is a sectional view taken along the line XII—XII of FIG. 11;

FIG. 13 shows view of a grommet member employed in the door latch device of the invention, taken from various directions;

FIG. 14 shows views of a snap-action member employed in the door latch device of the invention, taken from various directions, in which:

FIGS. 14(A), 14(B), 14(C) and 14(D) are respectively left side, front, right side and vertically sectional views of the snap-action member and FIGS. 14(E) and 14(F) are sectional views taken along the lines E—E and F—F of FIG. 14(B) respectively and FIG. 14(G) is a sectional view taken along the line G—G of FIG. 14(C);

DETAILED DESCRIPTION OF THE INVENTION

Figure 3:
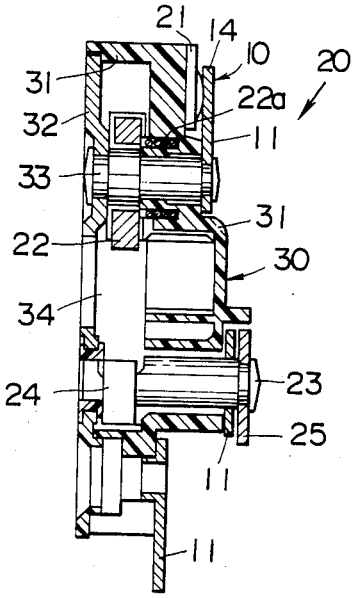

Referring to FIG. 1, there is shown an automotive door A which is hinged at its one side (viz., right side as viewed in the drawing) to a vehicle body B so that the door A can swing generally horizontally (viz., in the direction of the arrow X) relative to the vehicle body B. A door latch device 1 according to the present invention is mounted to the trailing edge of the door A, so that upon closing the door A, the door latch device 1 is brought into latching engagement with a striker $B_1$ secured to the vehicle body B.

As is understood from FIGS. 2 to 9, the door latch device 1 comprises generally three major sections, which are a generally L-shaped base plate 10 constructed of metal, a latch mechanism section 20 mounted to one wing portion 11 of the base plate 10 and a control mechanism section 40 mounted to the other wing portion 2 of the base plate 10. As will be understood from FIGS. 2, 4, 8 and 9, before mounting to the door, the door latch device 1 takes a generaly flat form with the latch and control mechanism sections 20 and 40 unfolded. However, upon proper assembly on the door A, it takes a generally L-shaped configuration as a whole, as will be seen from FIGS. 5 and 7.

For facilitation of explanation, the following description will be carried out with respect to the door latch device 1 in the unfolded condition.

The latch mechanism section 20 comprises a housing 30 which is mounted to the outside of the wing portion 11 of the base plate 10 for housing therein various parts as will become apparent as the description proceeds. The housing 30 comprises a plastic body 31 directly attached to the wing portion 11 and a metal cover plate 32 (see FIG. 4) securedly mounted on the plastic body 31 to define therebetween a parts-containing space (no numeral). For securing the housing 30 to the base plate 10, a shaft 33 extends through the housing 30 having both ends caulked to the cover plate 32 and the wing portion 11 of the base plate 10. The shaft 33 serves as a pivot shaft for a latch plate 22 as will become clear hereinafter. The plastic body 31 and the cover plate 32 are respectively formed with an elongate groove (no numeral) and an elongate cut (no numeral) which are aligned to provide the housing 30 with a so-called "striker receiving recess" 34 (see FIG. 4). The plastic body 31 is integrally formed with two spaced arms 35 extending toward the control mechanism section 40.

The control mechanism section 40 comprises a plastic body 50 to which various parts are mounted. The body 50 is integrally formed with two spaced arms 51 extending toward the latch mechanism section 20. The arms 51 are respectively formed at the leading ends thereof with small projections 51*a* which extend toward each other. The small projections 51*a* are snugly received in small bores (no numerals) formed in the two spaced arms 35 of the plastic body 31 of the latch mechanism section 20, so that a hinge structure is provided between the control and latch mechanism sections 40 and 20. That is, the control mechanism section 40 can pivot about the pivot axis of the hinge structure from the unfolded position to the assembled position wherein the inside major portion of the body 50 is in contact with the outside surface of the wing portion 12 of the base plate 10. The small projections 51*a* are so sized and constructed that they can disengage from the associated bores of the arms 35 when desired. The plastic body 50 is formed at its upper and lower portions with respective catching lugs 52 each having a pawl portion 52*a*. These catching lugs 52 an catch the upper and lower edges 12*a* and 12*b* of the wing portion 12 of the base plate 10 when the control mechanism section 40 is pivoted to the assembled position.

The latch mechanism section 20 will be described in detail hereinnext.

As is seen from FIG. 2, the plastic body 31 of the latch mechanism section 20 has at the upper portion thereof a lever 21 which is pivotally connected thereto through a pivot structure 36. The lever 21 is linked to an outside handle (not shown) which is arranged on an outside of the door A to be manipulated from the outside of the vehicle. Thus, hereinafter, the lever 21 will be referred to "outside lever" for simplification of the description. The head portion of the pivot structure 36 is concealed by a round cover 14 which is a part of the wing portion 11 of the base plate 10. The outside lever 21 has first and second ends 21*a* and 21*b* which are positioned oppositely with respect to the pivot structure 36. The first end 21*a* is pivotally connected to a link (not shown) which leads to the outside handle (not shown), so that manipulation of the outside handle induces pivotal movement of the outside lever 21 about the pivot structure 36. The second end 21*b* is bent toward this side in FIG. 2.

Figure 4:
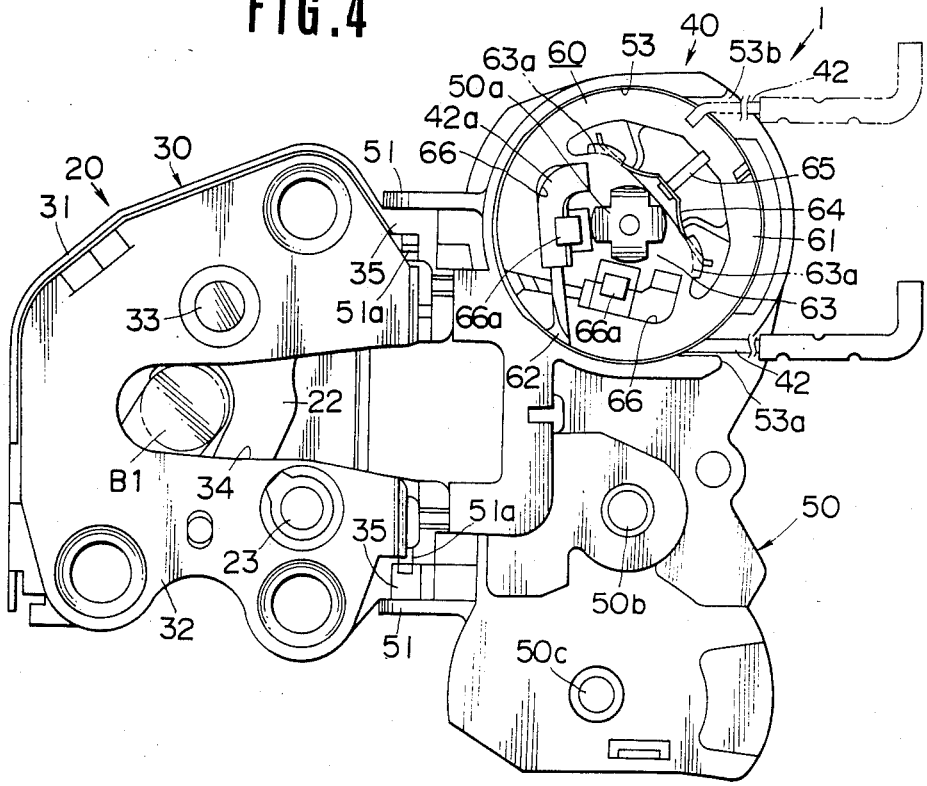
Figure 5:
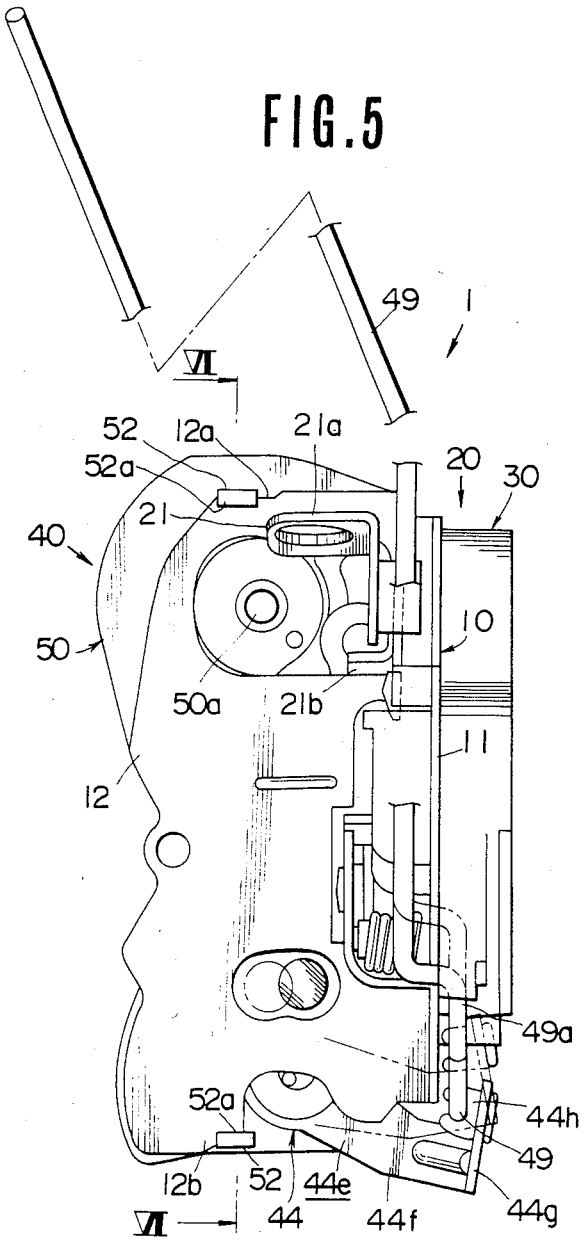
Figure 9:
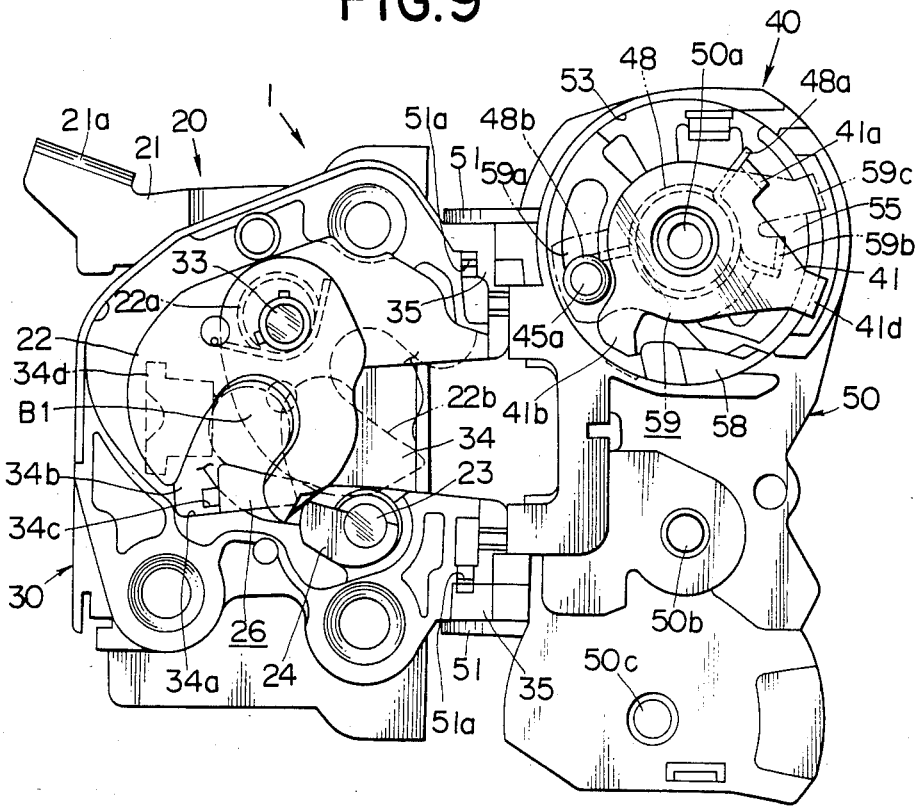
Figure 10A:
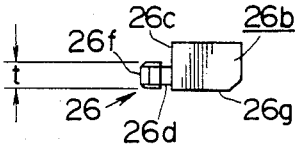
FIG. 10 shows views of a wedge member employed in the door latch device of the invention, taken from various directions.
Figure 10B:
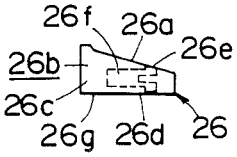
Figure 10C:
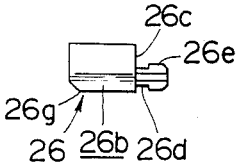
Figure 10D:
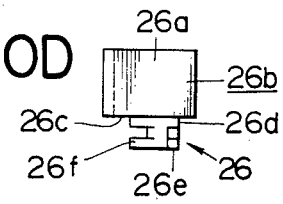

As is seen from FIG. 4, within the parts-containing space of the latch mechanism section 20, there is arranged a fork-shaped latch plate 22 which is pivotally supported by the shaft 33. As is best seen in FIG. 9, a coil spring 22*a* is disposed about the pivot shaft 33 with one end fixed to the latch plate 22 and the other end fixed to the plastic body 31, so that the latch plate 22 is biased to pivot in the direction of unlatched position (viz., toward the position illustrated by a broken line in FIG. 9). The latch plate 22 is so arranged that when assuming the unlatched position, a striker engaging port 22*b* defined in the latch plate 22 faces toward the entrance of the striker receiving recess 34, and when assuming the half-latched position, the port 22*b* faces toward the lower side of the recess 34, and when assuming the full-latched position, the port 22*b* faces toward the bottom of the recess 34. Within the parts-containing space, there is also arranged a pawl member 24 which is engageable with the forked ends (no numerals) of the latch plate 22 to allow the same to assume the half-latched and full-latched positions in a known manner. As is seen from FIG. 3, the pawl member 24 is integrally formed on a pivot pin 23 which extends parallel with the pivot shaft 33 of the latch plate 22 at the position near the lower side of the striker receiving recess 34. Thus, the pawl member 24 rotates together with the pivot pin 23 about the axis of the same. As is seen from FIG. 2, one end of the pivot pin 23 is projected this side from the plastic body 31 passing through an opening (no numeral) formed in a raised support portion 11*a* of the wing portion 11 of the base plate 10. A generally circular lever 25 is fixed to the projected portion of the pivot pin 23 to rotate therewith. Thus, hereinafter, the lever 25 will be referred to "pawl-associated lever". The pawl-associated lever 25 is formed with first and second arms 25*a* and 25*b*, the second arm 25*b* being bent toward the cover plate 32 (that is, toward the back side in FIG. 2). The pivotal movement of the lever 25 (viz., the pivotal movement of the unit consisting of the lever 25, the pivot pin 23 and the pawl member 24) is limited by the second arm 25*b* which is contactable with a rubber piece 25*c* fixed to the plastic body 31. The first arm 25*a* passes through an opening (no numeral) formed in the other wing portion 12, for the purpose which will become apparent as the description proceeds.

As is seen from FIG. 9, within the striker receiving recess 34, there is axially movably arranged a wedge member 26 constructed of a resilient material, such as rubber material. As will become clear hereinafter, the wedge member 26 acts as a shock absorber for the striker $B_1$ and is positioned away from the entrance of the striker receiving recess 34 with its thinner end facing toward the entrance of the recess 34, and is biased toward the entrance by means of biasing means. As is shown in detail in FIG. 10, the wedge member 26 comprises a major portion 26*b* on which an inclined surface 26*a* is defined to which the striker $B_1$ (more particularly, the outside positioned shank of the U-shaped striker $B_1$)is contactable upon closing of the door A. At one side 26*c* of the wedge member 26, there is integrally formed a projection 26*d*. The projection 26*d* is formed at its leading end with an engaging portion 26*e* which is somewhat enlarged in size. The enlarged engaging portion 26*e* is formed with a catch structure 26*f*.

As is seen in FIG. 9, the lower guide way of the striker receiving recess 34 is formed at the position distant from the entrance of the recess 34 with a sliding surface 34*a* on which the bottom surface 26*g* of the wedge member 26 is slidably seated. The bottom wall 34*b* of the striker receiving recess 34 (more particularly, the bottom wall of the elongate groove of the plastic body 31) is formed near the sliding surface 34*a* with a slit 34*c* which extends substantially parallel with the longitudinal axis of the striker receiving recess 34. The wedge member 26 is seated on the sliding surface 34*a* with the projection 26*d* slidably passing through the slit 34*c* and the enlarged engaging portion 26*e* projected outwardly from the slit 34*c*. (That is, in FIG. 12, the projection 26*d* is projected toward this side through the slit 34*c*.)

The catch structure 26*f* of the enlarged engaging portion 26*e* thus projected from the slit 34*c* catches one end 27*a* of a coil spring 27 which is disposed about a stud 37 of the plastic body 31 with the other end hooked to the body 31. With this spring, the wedge member 26 is biased toward the entrance of the striker receiving recess 34. At the deepest portion of the striker receiving recess 34, there is fixed a shock absorber 34*d* against which the striker $B_1$ collides upon closing of the door A.

The control mechanism section 40 will be described in detail hereinnext.

As is best seen in FIG. 4, the plastic body 50 of this section 40 is formed at its upper portion with a circular recess 53 into which a pulley-associated lever 41 and a pulley 60 are rotatably received as will be described hereinafter. The plastic body 50 is further formed, at a side opposite to the side where the circular recess 53 is formed, with a generally rectangular recess 54 in which several parts are arranged. It is thus appreciated that upon final assembly of the door latch device 1, the rectangular recess 54 faces or contacts the wing portion 12 of the L-shaped base plate 10, as will be understood from FIG. 2.

Within the circular recess 53 of the plastic body 50 is disposed a generally triangular or pulley-associated lever 41 which is rotatable about a pivot structure 50*a* arranged on the body 50. Designated by numeral 55 (see FIG. 8) is a bottom surface of the circular recess 53 to which the major surface of the lever 41 faces. Coaxially disposed on the lever 41 is the pulley 60 which winds thereon a cable 42 (see FIG. 4). The cable 42 leads to a known inside handle (not shown) arranged on the inboard side of the door A, so that manipulation of the inside handle induces rotational movement of the pulley 60 and the lever 41 in the recess 53 as will be described hereinafter.

As is seen from FIG. 2, within the generally rectangular recess 54 of the body 50 are arranged three levers, which are, a cancelling lever 43 pivotally connected to an intermediate portion of the body 50 through a pivot structure 50*b*, a locking-unlocking lever 44 pivotally connected to a lower portion of the body 50 through a pivot structure 50*c*, and an elongate sub-lever 45 arranged over both the cancelling lever 43 and the locking-unlocking lever 44. The upper end of the sub-lever 45 is provided with a pin 45*a* which is slidably received at its opposed end in an arcuate slot 55*a* concentrically formed in the bottom portion 55 of the circular recess 53.

Since the pivot structures 50*a*, 50*b* and 50*c* and the afore-mentioned pivot structure 36 have substantially the same construction, only one of them, that is, the pivot structure 50*b* will be described for simplification of the description.

Figure 6:
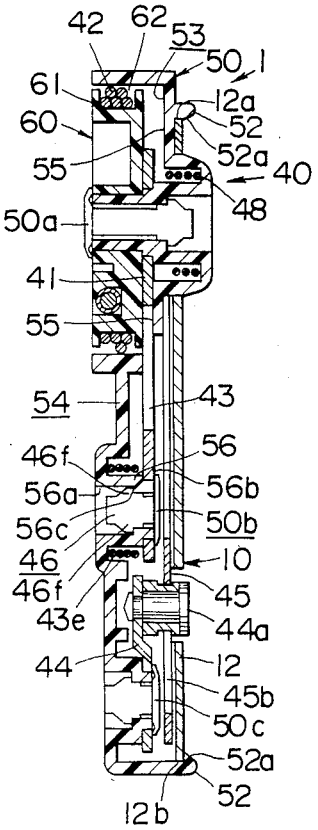

As will be understood from FIG. 6, the pivot structure 50*b* comprises an annular stud 56 perpendicularly raised from the bottom portion of the recess 54. The central through bore of the stud 56 is designated by numeral 56*a*, which is somewhat reduced in diameter at the entrance thereof thereby to form a shoulder portion 56*c*. The top portion 56*b* of the stud 56 is somewhat reduced in diameter, which is put in a circular opening (no numeral) of the cancelling lever 43 permitting the lever 43 to be rotatable thereabout. A headed pivot pin or grommet member 46 constructed of plastics is snapped into the central bore 56*a* of the stud 56 to pivotally hold the cancelling lever 43 on the stud 56. The grommet member 46 is formed with a radially projected stopper portion 46*d* (see FIG. 13) which abuts on the shoulder portion 56*c* of the central bore of the stud 56 to prevent disconnection of the pivot pin 46 from the stud 56.

FIG. 13 shows a detailed construction of the grommet member 46. As is understood from FIG. 13(C), the member 46 has at one end two crossing wings 46*b* and 46*c* which form the head of the grommet member 46, and as is understood from FIG. 13(B), one of the wings, that is, the wing 46*b* is formed with bent ends (no numeral) each inclining toward the tip of the grommet member 46. As is seen from FIGS. 13(A), 13(B) and 13(D), the radially projected stopper portion 46*d* comprises two lugs 46*f* which are radially outwardly projected from the diametrically opposed portions of the member 46, leaving at the backsides thereof slits 46*e*. Each lug 46*f* has at its top a stepped portion 46*g* which is abutted on the shoulder portion 56*c* of the central bore of the stud 56.

As is seen from FIG. 2, the elongate sub-lever 45 is formed at its lower end portion with a longitudinally extending slot 45*b*. A guide pin 44*a* mounted on a raised portion of the locking-unlocking lever 44 is slidably received in the elongate slot 45*b* of the sub-lever 45, so that pivotal movement of the locking-unlocking lever 44 about the pivot structure 50*c* induces pivotal movement of the sub-lever 45 about the pin 45*a* between "stand-by" and "rest" positions, as will be described hereinafter. For putting the guide pin 44*a* in the slot 45*b*, the latter is somewhat enlarged at the upper end. The sublever 45 has at its right side (in FIG. 2) a stepped portion 45*c*. Upon assembly of the door latch device 1, the stepped portion 45*c* is engageable with the aforementioned first arm 25*a* of the pawl-associated lever 25 of the latch mechanism section 20 when the sub-lever assumes the stand-by position. The sub-lever 45 further has at its left side (in FIG. 2) an expanded portion 45*d* which is engageable with a raised end (43*c*) of the cancelling lever 43.

The pivotal movement of the locking-unlocking lever 44 is carried out in a snap action manner by a snap action structure. The structure comprises a snap action member 47 which is constructed of plastics and axially slidably disposed on a thinner end portion 44*b* of the lever 44. As is shown in detail in FIG. 14, the snap action member 47 comprises a ring portion 47*b* extending from the base portion 47*a* of the member 47. The base portion 47*a* is formed with both a slot 47*c* into which the thinner end portion 44*b* of the lever 44 is slidably inserted, and a recess 47*d* in which a coil spring 47*g* is contained. The base portion 47*a* further has an engaging lug 47*e* which has a semicircular cross section as is seen from FIG. 14(B). As is best seen from FIGS. 15 and 16, the spring 47*g* is received in the recess 47*d* and the thinner end portion 44*b* of the locking-unlocking lever 44 is inserted in both the slot 47*c* and the coil spring 47*g* with its shoulder portion 44*c* (see FIG. 15) abutting on one end of the spring 47*g*. The other end of the coil spring 47*g* abuts on an end of the recess 47*d* so that the snap-action member 47 is biased away from the lever 44. The outward movement of the member 47 relative to the lever 44 is limited by engagement between a projection 44*d* of the lever 44 and an inward projection 47*f* of the member 47. The snap action structure further comprises a cam portion 57 which is formed on a peripheral wall of the rectangular recess 54 of the plastic body 50. The cam portion 57 is arranged to be substantially concentric with pivot structure 50*c* and slidably engageable with the engaging lug 47*e* of the snap-action member 47, as will be clearly described hereinnext.

Figure 15:
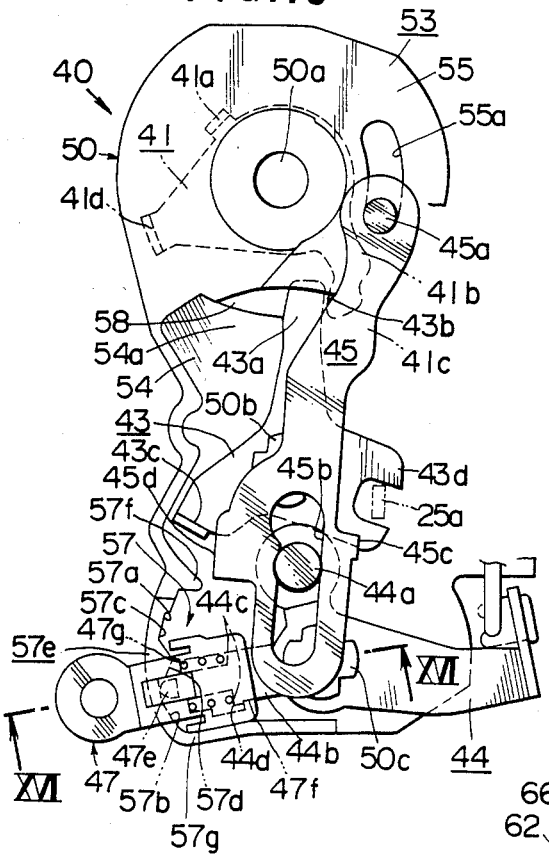
FIG. 15 is a front view of the control mechanism section of the door latch device in locked condition.
Figure 16:
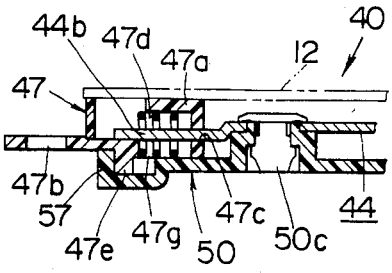
FIG. 16 is a sectional view taken along the line XVI—XVI of FIG. 15.

The cam portion 57 comprises two recesses 57*a* and 57*b* and a raised portion 57*e* which is positioned between the two recesses 57*a* and 57*b*. As is seen from FIG. 15, the raised portion 57*e* includes opposed inclined surfaces 57*c* and 57*d*. Each recess 57*a* or 57*b* has at its extreme end a stopper 57*f* or 57*g* which is engageable with a stopper lug (no numeral) of the member 47 to limit the pivotal movement of the locking-unlocking lever 44. By virtue of the spring 47*g*, the engaging lug 47*e* is pressed against the cam portion 57, so that the locking-unlocking lever 44 pivots, in a snap action manner, between a locking position wherein the engaging lug 47*e* of the member 47 is put in the recess 57*b* of the cam portion 57 (as shown in FIG. 15) and an unlocking position wherein the engaging lug 47*e* is put in the other recess 57*a* of the same (as shown in FIG. 2).

As is seen from FIG. 2, the locking-unlocking lever 44 has, at a portion opposite to the snap-action member-mounted arm 44*b*, an elongate bent arm portion 44*e* which comprises an arm base portion 44*f* extending radially outwardly from the pivoted portion (50*c*) thereof and a bent arm portion 44*g* extending perpendicular toward this side (in FIG. 2) from the base portion 44*f*. The leading end of the bent arm portion 44*g* is equipped with a clip 44*h* which is constructed of plastics. It is thus to be noted that, upon final assembly of the door latch device 1 wherein the control mechanism section 40 is attached to the wing portion 12 of the base plate 10, the bent arm portion 44*g* of the lever 44 comes to either one of the positions indicated by phantom lines $A_1$ in FIG. 2. The clip 44*h* of the lever 44, upon final assembly of the door latch device 1, holds an end of a rod 49 which extends to a key cylinder (not shown) mounted in the vehicle door. As is understood from FIGS. 2 and 5, the rod 49 extends along the peripheral end 38 of the housing 30 of the latch mechanism section 20 and has a crank portion 49*a* axially slidably received in a guide groove 38*a* formed in the plastic body 31 of the housing 30. A projection 38*b* is formed at the groove 38*a* to prevent disengagement of the rod 49 from the groove 38*a*. The rod 49 extending from the groove 38*a* is bent toward the clip 44*h* of the lever 44 and held by the clip 44*h*. The bent portion directly held by the clip 44*h* is designated by numeral 49*b* in FIG. 2.

As may be seen from FIG. 7, when viewed from the top of the assembled door latch device 1, the arm base portion 44*f* and the bent arm portion 44*g* of the locking-unlocking lever 44 and the bent portion 49*b* of the rod 49 are all concealed by the housing 30 of the latch mechanism section 20 and the body 50 of the control mechanism section 40. Furthermore, as is understood from FIG. 5, when the door latch device 1 assumes its locked condition, the arm base portion 44*f*, the bent arm portion 44*g*, the clip 44*h* of the lever 44 and the bent portion 49*b* of the rod 44 are all concealed behind the housing 30 of the latch mechanism section 20, as is indicated by a phantom line in the drawing. This is quite advantageous from the antitheft point of view. That is, such arrangement makes it impossible or at least difficult to handle the locking-unlocking lever 44 with a foreign tool, such as a hooked wire.

As is seen from FIGS. 2 and 9, the generally triangular or pulley-associated lever 41 in the circular recess 53 of the body 50 is rotatably disposed about the pivot structure 50*a*. The lever 41 is biased to rotate in a counterclockwise direction in FIG. 2 (that is, in a clockwise direction in FIG. 9) by biasing means. The biasing means comprises a coil spring 48 which is disposed at its multi-turn portion on an enlarged stud (no numeral) formed about the pivot structure 50*a* of the body 50 with its one end 48*a* hooked to a raised lug 41*a* of the lever 41 and the other end 48*b* hooked to the aforementioned pin 45*a* of the elongate sub-lever 45. Engaging the end 48*b* of the spring 48 with the pin 45*a* biases the sub-lever 45 in the downward direction in FIG. 2.

As is understood from FIG. 2, the plastic body 50 of the control mechanism section 40 is formed with a generally oval slot 58 which opens to both the circular recess 53 for the pulley 60 and the rectangular recess 54 for the levers 43, 44 and 45. It is to be noted that the oval slot 58 has a certain depth in the direction perpendicular to the major surface of the body 50. Projecting into the rectangular recess 54 through the oval slot 58 is a lock cancelling arm 41*b* which is a part of the pulley-associated lever 41, while, projecting into the circular recess 53 through the oval slot 58 is a driven arm 43*a* which is a part of the cancelling lever 43. The lock cancelling arm 41*b* of the lever 41 and the driven arm 43*a* of the cancelling lever 43 are slidably engageable at their side portions and movable together on a common plane which is perpendicular to the major surface of the body 50. For achieving the movement of these arms 41*b* and 43*a* on the common plane, it is necessary to equalize the depth of the oval slot 58 with the thickness of each of the arms 41*b* and 43*a*. The mutually engageable sides of the lock cancelling arm 41*b* and the driven arm 43*a* are designated by numerals 41*c* and 43*b* respectively in FIG. 2.

The cancelling lever 43 further has a cancelling end 43*c* which is contactable with the expanded portion 45*d* of the sub-lever 45, and a forked end 43*d* which is engageable with the first arm 25*a* of the aforementioned pawl-associated lever 25 of the latch mechanism section 20. More particularly, the forked end 43*d* pivotally holds the first arm 25*a* of the lever 25 when the door latch device 1 assumes its finally assembled condition. A coil spring 43*e* is disposed about its multi-tuned portion about an enlarged stud portion (no numeral) formed about the pivot structure 50*b* of the body 50 with its one end hooked to the driven arm 43*a* of the cancelling lever 43 and the other end hooked to the body 50. With this spring 43*e* the cancelling lever 43 is biased to rotate in a clockwise direction in FIG. 2 about the pivot structure 50*b*, that is in the direction to press the driven arm 43*a* against the lock cancelling arm 41*b* of the pulley-associated lever 41.

Figure 17:
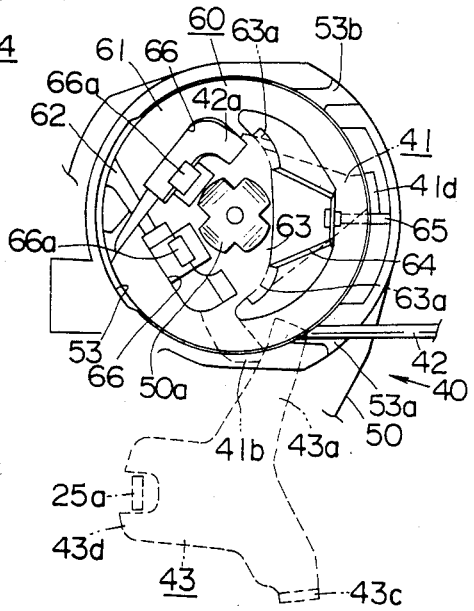
FIG. 17 is a back but partial view of the control mechanism section of the door latch device at the position where a pulley is mounted.

As is best seen from FIGS. 4 and 6, the pulley 60 is formed at the peripheral wall portion 61 with an annular groove 62 for winding thereon the cable 42. The pulley 60 is further formed with a generally arcuate recess (no numeral) having a pair of inclined surfaces 63*a* at the opposed ends thereof. A bow-shaped spring 64 is disposed in the arcuate recess with its foot portions respectively put on the inclined surfaces 63*a*. The top portion of the spring 64 is equipped with a stopper piece 65 which is projected into the annular groove 62 through a slot (no numeral) formed in the bottom of the groove 62. By the spring 64, the stopper piece 65 is biased in a direction away from the center of the pulley 60. As is seen from FIG. 17, the projected end of the stopper piece 65 is engageable with a raised end 41*d* of the pulley-associated lever 41. The pulley 60 is further formed, at the portion opposite to the arcuate recess, with symmetrically arranged cable catching structures 66. Each structure 66 comprises a generally L-shaped groove 66 which extends from the peripheral portion of the pulley 60 to a portion near the center of the same, as shown. A generally L-shaped metal tip 42*a* fixed to the cable 42 is received in the L-shaped groove 66. The cable 42 is wound on the annular groove 62 and extends to the inside handle (not shown) of the vehicle door. A retainer lug 66*a* is provided in each of the grooves to hold the metal tip 42*a* in the same. The annular wall of the pulley receiving recess 53 is formed with two cuts 53*a* and 53*b* each serving as a guide for the cable 42.

In the following, assembling process of the door latch device 1 having the above-mentioned construction will be described.

The assembly of the latch mechanism section 20 and that of the control mechanism section 40 are independently carried out.

For assembling the latch mechanism section 20, the outside lever 21, the latch plate 22 and the pivot pin 23 of the pawl member 24 are at first mounted to or in the plastic body 31. The wedge member 26 is inserted in the striker receiving recess 34 from the entrance thereof with the thinner end portion thereof facing toward the entrance of the recess 34, and put on the sliding surface 34*a* of the recess 34 with its one side 26*c* contacting with the bottom wall 34*b* of the recess 34. With this process, the projection 26*d* having the catch portion 26*f* is projected to the back side through the slit 34*c* of the plastic body 31, so that the wedge member 26 is slidable on the sliding surface 34*a* with the projection 26*d* thereof guided by the slit 34*c*. It is to be noted that the thickness "t" (see FIG. 10(A)) of the catch portion 26*f* is somewhat greater than the width of the slit 34*c*. Thus, the wedge member 26 does not get loose even when the housing 30 is turned upside down during assembling work. Then, the coil spring 27 is disposed about the stud 37. One end of the spring 27 is hooked to the catch portion 26*f* and the other end of the same is hooked to the housing 30. With this, the wedge member 26 is biased to assume its forwardmost position on the sliding surface 34*a* of the striker receiving recess 34 with the projection 26*d* in abutment with the forward end of the slit 34*c*.

Thereafter, the sub-assembled plastic body 31 is put on the wing portion 11 of the base plate 10 and the cover plate 32 is put on the outboard side of the plastic body 31. Then, the pivot shaft 33 is passed through three aligned holes (no numerals) of the cover plate 32, the plastic body 31 and the wing portion 11, while passing through the pivot hole (no numeral) of the latch plate 22. The both ends of the shaft 33 are caulked to assemble the members 32, 31 and 11 together. During this process, the outboard end of the pivot pin 23 is put in an opening (no numeral) of the cover plate 32. Thereafter, the pawl-associated lever 25 is fixed to the other end (which is projected to the inboard side of the assembled housing 30) of the pivot pin 23 by caulking the same.

For assembling the control mechanism section 40, the cancelling lever 43 is at first mounted to the plastic body 50 in the following manner. After putting the coil spring 43*e* about the annular stud 56 of the body 50, the cancelling lever 43 is disposed at its circular opening (no numeral) about the stud 56. Then, the grommet member 46 is snapped into the central bore 56*a* of the stud 56 having the head (46*b*, 46*c*) thereof abutted on the major surface of the cancelling lever 43. During insertion of the grommet member 46 into the stud 56, the radially outwardly projected lugs 46*f* of the member are forced to be resiliently bent inwardly by the diameterically reduced entrance portion of the central bore 56*a* of the stud 56 and, after passing through the reduced portion, they are expanded to assume their original forms. Thus, the cancelling lever 43 is pivotally supported by the stud 56 without disengagement therefrom.

Then, the locking-unlocking lever 44 is mounted to the plastic body 50 in the following manner. First, the snap-action member 47 is mounted to the arm 44*b* of the lever 44. Thereafter, the locking-unlocking lever 44 is mounted on the pivot structure 50*c* with the snap-action member 47 (viz., the engaging lug 47*e*) kept pressed against the cam portion 57 of the plastic body 50.

Then, the sub-lever 45 is put in the rectangular recess 54 of the body 50 with the elongate slot 45*b* thereof operatively receiving therein the guide pin 44*a*. Then, the other pin 45*a* on the sub-lever 45 is put in the arcuate slot 55*a* formed in the bottom portion 55 of the circular recess 53.

Thereafter, the coil spring 48 is disposed about the stud of the pivot structure 50*a* in the pulley receiving circular recess 53, and the lever 41 is pivotally mounted to the stud. One end 48*b* of the spring 48 is hooked to the pin 45*a* of the sub-lever 45 and the other end 48*a* of the same is hooked to the raised lug 41*a* of the lever 41. The lock cancelling arm 41*b* of the lever 41, under this condition, is projected into the rectangular recess 54 through the oval slot 58 and slidably engaged with the driven arm 43*a* of the cancelling lever 43.

Thereafter, the pulley 60 is set in the circular recess 53 in the following manner. Before putting into the recess 53, the pulley 60 is manipulated to wind thereon the cable 42. With this cable winding, the stopper piece 65 is drawn back into the pulley 60 against the biasing force of the bow-shaped spring 64. This drawn back condition of the stopper piece 65 will be understood from FIG. 4. Then, the pulley 60 with the cable 42 wound thereon is disposed about the stud of the pivot structure 50*a* in the recess 53 and pivotally connected thereto by fitting the grommet member to the stud.

In order to assemble the latch mechanism section 20 and the control mechanism section 40 together, the following process is carried out. First, by slightly expanding the spaced arms 51 of the control mechanism section 40 away from each other, the small projections 51*a* of the arms 51 are snugly fitted in the bores of the two arms 35 of the latch mechanism section 20, so that control mechanism section 40 is hinged to the latch mechanism section 20. The control mechanism section 40 is then pivoted and pressed against the outside surface of the wing portion 12 of the base plate 10 by a certain force. With this, the catching lugs 52 of the control mechanism section 40 are brought into latching engagement with the upper and lower edges 12*a* and 12*b* of the wing portion 12, so that the two sections 20 and 40 are assembled together taking a generally L-shaped configuration. During this process, the outside lever 21 and the pawl-actuated lever 25 of the latch mechanism section 20 keep the positions as shown in FIG. 2 wherein the second end 21*b* of the outside lever 21 and the first arm 25*a* of the lever 25 are in their lower positions. Thus, upon assembly, the second end 21*b* of the outside lever 21 is placed at the lower portion of the pin 45*a* and the first arm 25*a* of the lever 25 is put in the recess (no numeral) of the forked end 43*d* of the cancelling lever 43. Furthermore, upon assembly, the clip 44*h* of the locking-unlocking lever 44 is placed at the lower portion of the latch mechanism section 20, as will be understood from the clip illustrated by a phantom line in FIG. 2.

The assembled door latch device 1 is mounted to the trailing edge of the door A in a conventional manner. The cable 42 is then drawn out from the pulley 60 by rotating the same and connected to the inside lever (not shown) of the door A. With the cable 42 being drawn out from the pulley 60, the stopper piece 65 is returned to its outwardly projected position (see FIG. 17) by the force of the bow-shaped spring 64 so that it is brought into engagement with the raised end 41*d* of the pulley-associated lever 41. It is to be noted that when, under this condition, the cable 42 is pulled toward the inside handle of the door due to, for example, manipulation of the same, the pulley 60 is forced to rotate urging the stopper piece 65 to push the raised end 41*d* of the lever 41 in a counterclockwise direction in FIG. 17 against the biasing force of the coil spring 48. Thus, upon release of operator's hand from the inside handle, the pulley 60 is somewhat rotated in the cable winding direction. The first end 21*a* of the outside lever 21 is pivotally connected to a link (not shown) which leads to the outside handle (not shown) of the door A. The clip 47*h* of the locking-unlocking 44 grips one end of the rod 49 which extends to a key cylinder which is mounted in the door A with its key hole facing the outside of the door A. Thus, the rotational movement of the key cylinder due to manipulation of a specialized key fitted thereto induces pivotal and snap-action movement of the locking-unlocking lever 44 about the pivot structure 50*c*. Furthermore, the ring portion 47*b* of the snap-action member 47 is linked to a locking knob (not shown) which is usually mounted near the window lower frame of the door A. Thus, manipulation of the locking knob also induces the pivotal movement of the locking-unlocking lever 44.

In the following, operation of the properly assembled door lock device 1 will be described. For easy understanding of movements of parts employed in the device 1, the description of the operation will be made with reference to FIG. 2 in which the latch mechanism section 20 and the control mechanism section 40 are shown as being unfolded and assuming the latched but unlocked condition of the device 1. In this condition, the latch plate 22 is in its full-latched position (see FIG. 4) grasping the striker $B_1$ with the locking-unlocking lever 44 assuming its unlocking position as shown in FIG. 2. That is, the vehicle door A is kept closed with the door latch device 1 unlocked.

When, now, the outside lever 21 is pivoted clockwise due to manipulation of the outside handle of the door, the second end 21*b* of the lever 21 pushes the pin 45*a* and thus the elongate sub-lever 45 upward against the biasing force of the spring 48. The upward movement of the sub-lever 45 causes the stepped portion 45*c* thereof to abut on the first arm 25*a* of the pawl-associated lever 25 and urge the same upwardly inducing a clockwise rotation of the lever 25. With this rotation of the lever 25, the pawl member 24 fixed thereto is rotated to a position to completely release the latch plate 22. Thus, in response to the opening movement of the door A, the latch plate 22 is forced to swing to its unlatched position by virtue of the coil spring 22.

Figure 18:
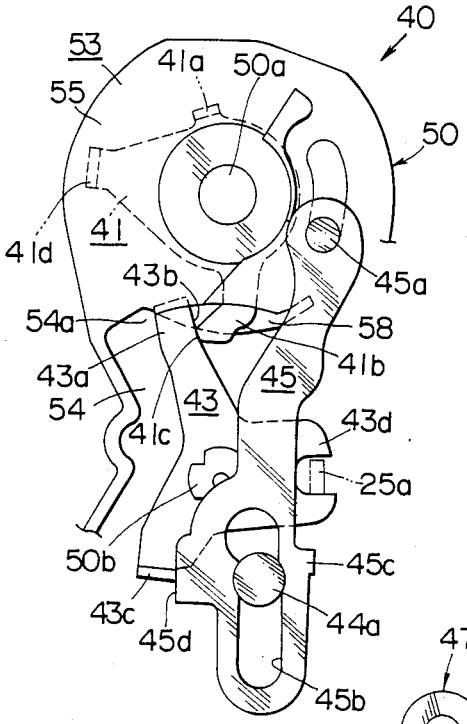
FIG. 18 is a front but partial view of the control mechanism section of the door lock device in an unlocked condition conducted by a pulley-associated lever.
Figure 19:
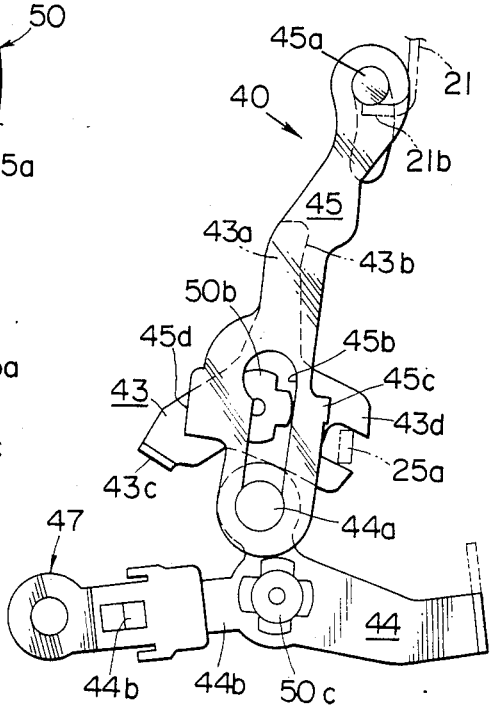
FIG. 19 is a front but partial view of the control mechanism section at the position where a sub-level is arranged, the sub-lever being shown in its inoperative condition.

When, under the latched but unlocked condition of the door latch device 1, the cable 42 is pulled away from the device 1 due to manipulation of the inside handle of the door, the pulley 60 rotates urging the pulley-associated lever 41 in the clockwise direction in FIG. 18. This rotation of the lever 41 causes the lock cancelling arm 41*b* to push the driven arm 43*a* of the cancelling lever 43 in the counterclockwise direction in FIGS. 2 and 18. The rotation of the cancelling lever 43 causes the forked end 43*d* thereof to abut on the first arm 25*a* of the pawl-associated lever 25 and urges the same upwardly. Thus, the latch plate 22 is swung to the unlatched position, similar to the case of the above-mentioned operation of the outside lever 21.

When, under the latched but unlocked condition, the key cylinder or the locking knob mounted to the door A is manipulated for the purpose of locking the door to the vehicle body, the locking-unlocking lever 44 is pivoted to its locking position wherein the snap-action member 47 is incorporated with the recess 57*b* of the cam portion 57 as shown in FIG. 15. With the pivoting movement of the locking-unlocking lever 44, the guide pin 44*a* on the lever 44 urges the elongate sub-lever 45 leftward in FIG. 2 thereby rotating the same clockwise about the other guide pin 45*a*. This means that the stepped portion 45*c* of the sub-lever 45 moves away from the first arm 25*a* of the pawl-associated lever 25, and the expanded portion 45*d* of the sub-lever 45 comes near to the cancelling end 43*c* of the cancelling lever 43.

When, under this condition, the outside lever 21 is pivoted to move the elongate sub-lever 45 upwardly in FIG. 2, the stepped portion 45*c* of the sub-lever 45 fails to engage the first arm 25*a* of the lever 25 thereby disabling the latch plate 22 from taking the unlatched position.

However, when, under this locked condition, the cable 42 is pulled away from the device 1 due to manipulation of the inside handle of the door, the lock cancelling arm 41*b* of the pulley-associated lever 41 moves the cancelling lever 43 in the counterclockwise direction thereby urging the first arm 25*a* of the pawl-associated lever 25 upwardly. Thus, the latch plate 22 is swung to the unlatched position. During the counterclockwise movement of the cancelling lever 43, the cancelling end 43*c* of the lever 43 instantly comes into contact with the expanded portion 45*d* of the sub-lever 45 and thus rotates the same about the guide pin 45*a* in the counterclockwise direction in FIG. 2. Due to the pivotal connection between the sub-lever 45 and the locking-unlocking lever 44 through the guide pin 44*a*, the counterclockwise movement of the sub-lever 45 induces a pivotal movement of the locking-unlocking lever 44 from the locking position as shown in FIG. 15 to the unlocking position as shown in FIG. 2.

When the door A is brought into its closed position with the door latch device 1 assuming the locked condition, the striker $B_1$ on the vehicle body comes to contact with the latch plate 22 and thus pushes the same to the full-latched position. During this movement of the latch plate 22, the forked ends of the latch plate 22 contact and push the pawl member 24 to rotate the same about the axis thereof. With this rotation, the pawl-associated lever 25 rotates clockwise in FIG. 2 urging the first arm 25*a* thereof to push the forked end 43*d* of the cancelling lever 43 upwardly thereby pivoting the cancelling lever 43 in the counterclockwise direction. Thus, the cancelling end 43*c* of the lever 43 pushes the expanded portion 45*d* of the sub-lever 45 to rotate the same about the guide pin 45*a*. Thus, the locking-unlocking lever 44 is pivoted to the unlocking position by the same reasons as mentioned hereinabove. It is to be noted that this lock cancelling operation is carried out against the biasing force of the coil spring 43*e* applied to the cancelling lever 43. Thus, upon completion of pivoting the lever 44 to the unlocking position, the pawl member 24 is forced to return to its original position thereby holding the latch plate 22 in the latched position. Thus, when the door A is closed with the door latch device 1 locked (that is, with the locking-unlocking lever 44 assuming the locking position), the door A is latched to the vehicle body while cancelling the locked condition of the device 1. By the reason now mentioned, the door latch device 1 of the present invention is particularly appropriate for a door which is positioned beside the driver's seat.

When, however, the above-mentioned door closing operation is carried out with the outside handle kept manipulated, the door A can be latched to the vehicle body without cancelling the locked condition of the device 1. That is, so-called "Keyless locking" is achieved. Due to manipulation of the outside handle, the outside lever 21 is pivoted in the direction to pull up the elongate sub-lever 45 to such a degree that the expanded portion 45*d* of the lever 45 is positioned away from the path of the cancelling end 43*c* of the cancelling lever 43. Thus, the counterclockwise rotation of the cancelling lever 43, which will occur during rotation of the latch plate 22 to the full-latched position, fails to induce engagement between the cancelling end 43*c* of the lever 43 and the expanded portion 45*d* of the lever 45. Thus, the locked condition of the door latch device 1 is not cancelled in this case.

It is to be noted that the door latch operation of the device 1 is smoothly and softly achieved by the provision of the spring-biased wedge member 26. That is, upon closing of the door A, the striker $B_1$ comes into collision with the wedge member 26 pushing the same against the biasing force of the coil spring 27. Thus, the impact shock applied to the door latch device 1 is softened thereby minimizing the play of the door A upon closing of the door.

Figure 21:
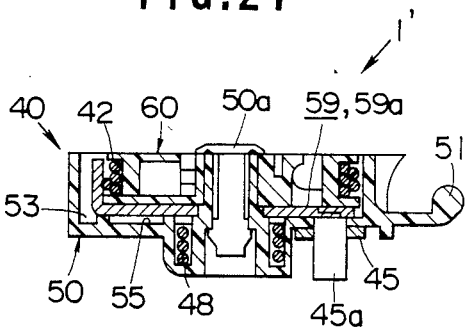
FIG. 21 is a horizontally sectional view of a control mechanism section which is employed in a modification of the door lock device of the invention.
Figure 20:
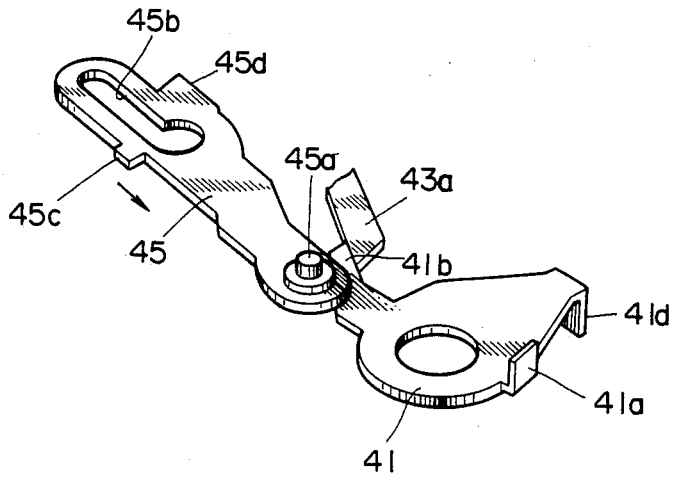
FIG. 20 is a perspective view showing a positional relationship between the sub-lever, the pulley-associated lever an cancelling lever.

Referring to FIG. 21, there is shown but partially a modification of the door latch device 1 of the invention. The part shown in this drawing is corresponding to the upper part of the control mechanism section 40 of FIG. 2 where the pulley 60 is arranged. As will be understood hereinafter, in the modified door latch device 1', the locked condition of the device 1' can not be cancelled even when the inside handle of the door is manipulated, unlike the case of the afore-mentioned device 1.

In this modification, a different pulley-associated lever 59 is used in place of the lever 41 and arranged to bias the pulley 60 in a direction opposite to that mentioned hereinbefore by virtue of the spring 48. The modified door latch device 1' will be described with reference to FIGS. 2 and 9 in which the pulley-associated lever 59 is illustrated by a phantom line.

Figure 22:
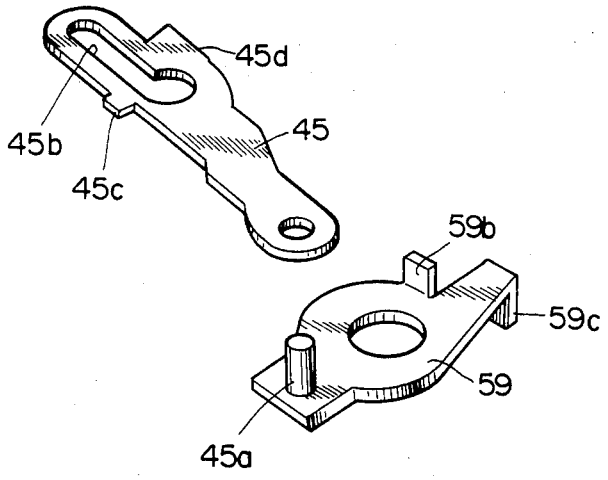
FIG. 22 is a perspective view showing a positional relationship between the sub-lever and the pulley-associated lever which are employed in the modification.

As is seen from FIG. 2, within the circular recess 53 of the plastic body 50, the pulley-associated lever 59 is disposed to be rotatable about the pivot structure 50*a*. The lever 59 is formed with a raised lug 59*b* to which an end of a coil spring 48 is hooked. The coil spring 48 is disposed at its multi-turn portion about the enlarged stud portion (no numeral) of the body 50. As is seen in FIG. 22, the lever 59 has a pin (45*a*) at the position opposite to the raised lug 59*b* with respect to the pivoted portion of the lever 59. The pin (45*a*) is pivotally received in a circular opening (no numeral) formed in the upper portion of the sub-lever 45 thereby establishing a pivotal connection therebetween. The other end of the coil spring 48 is hooked to the pin (45*a*) so that the lever 59 is biased in a clockwise direction in FIG. 2 (that is, in a counterclockwise direction in FIG. 9). The lever 59 further has a backwardly bent end 59*c* which is engageable with the stopper piece 65 provided on the pulley 60 so as to bias the pulley 60 in a clockwise direction in FIG. 2 (that is, in a counterclockwise direction in FIG. 9). As will be understood from FIG. 4 in which the cable 42 associated with the modified door latch device 1' is illustrated by a phantom line, the cable 42 is wound on the pulley 60 in a reversed fashion as compared with the afore-mentioned device 1 and passed through the other cable guide cut 53*b* of the body 50.

Operation of the modified door latch device 1' will be described with reference to FIG. 2. The device 1' shown in this drawing assumes the latched but unlocked condition.

When the outside lever 21 is pivoted clockwise, the second end 21*b* of the lever 21 pushes the pin (45*a*) upwardly thereby moving the sub-lever 45 upwardly against the biasing force of the spring 48. This upward movement of the sub-lever 45 permits pivoting of the latch plate 22 to its unlatched position, as is described hereinafore. It is to be noted that unlike the case of the device 1, the upward movement of the sub-lever 45 in this modification induces simultaneous rotation of the pulley-associated lever 59 in the counterclockwise direction in FIG. 2.

When, under the latched but unlocked condition, the cable 42 is pulled away from the device 1' against the biasing force of the spring 48, the lever 59 is rotated counterclockwise thereby pulling up the sub-lever 45. Thus, the latch plate 22 is pivoted to its unlatched position.

When, under the latched but unlocked condition, the key cylinder or the locking knob mounted to the door A is manipulated for the purpose of locking the door to the vehicle body, the locking-unlocking lever 44 is pivoted to its locking position wherein the snap-action member 47 is incorporated with the recess 57*b* of the cam portion 57 as shown in FIG. 15. With this pivoting movement of the lever 44, the sub-lever 45 is pivoted leftward away from the first arm 25*a* of the pawl-associated lever 25. Thus, the latched condition of the latch plate 22 is locked because of the disengagement between the sub-lever 45 and the first arm 25*a* of the pawl-associated lever 25. It is thus to be appreciated that in this modified device 1', manipulation of the inside handle of the door does not induce cancelling of the locked condition of the latch plate 22, unlike the case of the device 1.

When the door A is brought into its closed position with the device 1' locked, the door A is latched to the vehicle body while cancelling the locked condition of the device 1'. Since the operation of the device 1' in this case is substantially the same as that mentioned in the device 1, description of it will be omitted.

When the door closing operation is carried out with the outside handle kept manipulated, the door A can be latched to the vehicle body without cancelling the locked condition of the device 1'. That is, so-called "Keyless locking" is achieved. Since the operation of this keyless locking is substantially the same as that mentioned in the device 1, description of it will be also omitted.

As will be understood from the above, in the door latch device of the invention, the assembly of the device per se can be carried out with the two major sections (viz., latch mechanism section and control mechanism section) separated. This assembling facilitates mounting of parts to their given portions because only simple movements of the parts are necessary and thus lends itself to assembly by automatic assembling devices.

What is claimed is:

1. A door latch device comprising:

a generally L-shaped base plate having first and second wing portions;

a latch mechanism section secured to said first wing portion, said latch mechanism section including means for latching a striker when the same is brought into engagement therewith;

a control mechanism section including means for controlling the operation of said latch mechanism section, said control mechanism section being mounted to said second wing portion of the base plate;

hinge means for pivotally connecting said latch and control mechanism sections together and disconnecting them from each other when desired; and snap fastening means for detachably fastening said control mechanism section to said second wing portion in a snap action manner.

2. A door latch device as claimed in claim 1, in which said hinge means comprises:

two spaced arms formed on said latch mechanism section, each having at the leading end portion a bore; and two spaced arms formed on said control mechanism section, each having at the leading end portion a projection, said projections being respectively fitted in said bores thereby achieving the pivotal connection between said latch and control mechanism sections.

3. A door latch device as claimed in claim 2, in which said snap fastening means comprises:

two spaced catching lugs formed on said control mechanism section; and two spaced edge portions of said second wing portion, said catching lugs being brought into latching engagement with said spaced edge portions of said second wing portion thereby detachably fastening the control mechanism section to said second wing portion.

4. A door latch device as claimed in claim 2, in which said two spaced arms of said latch mechanism section and those of said control mechanism section are respectively parts of plastic bodies on which the parts of said latch mechanism section and those of said control mechanism section are arranged respectively.

5. A door latch device as claimed in claim 4, in which said two spaced catching lugs of said snap fastening means are parts of the plastic body of said control mechanism section.

6. A door latch device as claimed in claim 1, in which said latch mechanism section comprises:

a housing securely mounted on said first wing portion and having a striker receiving recess into which said striker is insertable;

a latch plate pivotally mounted in said housing for latching said striker;

biasing means for biasing said latch plate in a direction to unlatch said striker;

a pawl member pivotally arranged near said latch plate to permit the same to selectively assume full-latched, half-latched and unlatched positions with aid of said biasing means; and a pawl-associated lever connected to said pawl member to rotate therewith, said pawl-associated lever being exposed to the inboard side of said L-shaped base plate so that, upon proper mounting of said control mechanism section to said second wing portion, the lever is brought into operative connection with essential parts of said control mechanism section.

7. A door latch device as claimed in claim 6, in which said control mechanism section comprises:

a plastic body having first and second recesses on the opposed sides thereof;

a pulley-associated lever rotatably disposed in said first recess and having a lock cancelling arm projectable into said second recess;

a pulley rotatably disposed in said first recess and put on said pulley-associated lever to be rotatable therewith;

a cancelling lever pivotally disposed in said second recess and having first, second and third work ends, said first work end being engageable with said lock cancelling arm of said pulley-associated lever, said third work end being engageable with said pawl-associated lever upon proper mounting of said control mechanism section to said second wing portion of the base plate;

a locking-unlocking lever pivotally disposed in said second recess and having a guide pin fixed thereto;

an elongate sub-lever having at one end portion an elongate guide slot into which said guide pin of said locking-unlocking lever is slidably inserted, said sub-lever having fourth and fifth work ends, said fourth work end being engageable with said pawl-associated lever upon proper mounting of said control mechanism section to said second wing portion of the base plate, said fifth work end being engageable with said second end of said cancelling lever upon rotation of the latter in a certain direction; and guiding and pivoting means for guiding a longitudinal movement of said sub-lever while permitting the same to pivot about the other end of the same.

8. A door latch device as claimed in claim 7, in which said guiding and pivoting means comprises:

a guide pin fixed to the other end of said sub-lever;

an arcuate guide slot formed in said plastic body of said control mechanism section, said guide pin being slidably received in said guide slot.

9. A door latch device as claimed in claim 8, in which said control mechanism section further comprises:

first biasing means for biasing said pulley-associated lever and said pulley to rotate in a common direction to move said lock cancelling arm away from said first work end of said cancelling lever;

second biasing means for biasing said cancelling lever in a direction to press said first work end thereof against said lock cancelling arm; and third biasing means biasing said sub-lever to longitudinally move in a direction away from said pawl-associated lever.

10. A door latch device as claimed in claim 9, in which said first and third biasing means comprise a common coil spring disposed about a pivot structure formed on the bottom of said first recess.

11. A door latch device as claimed in claim 9, in which said control mechanism section further comprises a snap action means by which the pivoting movement of said locking-unlocking lever is carried out in a snap action manner.

12. A door latch device as claimed in claim 11, in which said snap action means comprises:

a cam portion formed on a peripheral wall of said plastic body of said control mechanism section;

a plastic body having a recess formed therein for slidably receiving therein an end of said locking-unlocking lever; and fourth biasing means for biasing said plastic body away from said end of the locking-unlocking lever, so that upon proper assembly of said snap action means, a projection of said plastic body is slidably pressed against the cam surface of said cam portion.

13. A door latch device as claimed in claim 12, in which said plastic body is formed with a ring portion linkable to a locking knob mounted in the door, and in which the other end of said locking-unlocking lever is linkable to a key cylinder mounted in the door.

14. A door latch device as claimed in claim 7, in which said pulley-associated lever, said cancelling lever and said sub-lever are pivotally connected to said plastic body through respective pivot structures which have substantially the same construction, each comprising:

an annular stud formed on said plastic body, said stud having a through bore which is somewhat reduced in diameter at the entrance thereof thereby forming a shoulder portion at the entrance, said stud being somewhat reduced in diameter at the top thereof to be put in a circular opening formed in the associated lever; and a grommet member constructed of plastic and snapped into the bore of the stud with its head portion abutted on the associated lever.

15. A door latch device as claimed in claim 14, in which said head portion of said grommet member comprises two crossing wings one of which is formed with bent ends each inclining toward the tip of the grommet member, and in which said grommet member is formed at the shank portion thereof with a radially projected stopper portion which, upon proper fitting of said grommet to said stud, abuts on the shoulder portion of the bore of the stud thereby preventing disconnection of the associated lever from said stud.

16. A door latch device as claimed in claim 8, in which said latch mechanism section mounts thereon an outside lever, said outside lever being so arranged that, upon proper mounting of said control mechanism section to said second wing portion of the base plate, one end of said outside lever is brought into engagement with the guide pin of the other end of said sub-lever.

17. A door latch device as claimed in claim 6, in which said latch mechanism section further comprises a shock absorber arranged in said striker receiving recess for absorbing impact shock applied thereto by said striker.

18. A door latch device as claimed in claim 17, in which said shock absorber comprises:

a wedge member constructed of an elastic material and movable longitudinally in said striker receiving recess;

biasing means for biasing said wedge member toward the entrance of said striker receiving recess; and stopper means for limiting the movement of said wedge member in the direction of said entrance.

19. A door latch device as claimed in claim 18, in which said stopper means comprises a projection formed on said wedge member and a slit formed in said housing of said latch mechanism section, said slit slidably receiving therein said projection of the wedge member thereby to guide the movement of said wedge member in said striker receiving recess.

20. A door latch device as claimed in claim 19, in which said biasing means comprises a coil spring which is disposed about a stud of said housing with one end hooked to the top of said projection and the other end hooked to said housing.

21. A door latch device as claimed in claim 13, in which said locking-unlocking lever has a generally L-shaped configuration so that upon proper mounting of said control mechanism section to said second wing portion of the base plate, the other end of said locking-unlocking lever is placed in the vicinity of said latch mechanism section to be concealed by the same.

22. A door latch device as claimed in claim 21, in which the other end of said locking-unlocking lever is equipped with a clip which pivotally catches an end of a rod which extends to a key-cylinder mounted in a door.

23. A door latch device as claimed in claim 22, in which said rod has a portion which is slidably received in a groove formed in said housing of the latch mechanism section.

24. A door latch device as claimed in claim 23, in which said housing comprises a plastic body secured to said first wing portion of the base plate and a cover plate mounted to the outside of said body to define therebetween a parts-containing space.

25. A door latch device as claimed in claim 6, in which said control mechanism section comprises:

a plastic body having first and second recesses on the opposed sides thereof;

a pulley-associated lever rotatably disposed in said first recess and having a pin fixed thereto;

a pulley rotatably disposed in said first recess and put on said pulley-associated lever to be rotatable therewith;

a cancelling lever pivotally disposed in said second recess and having second and third work ends, said third work end being engageable with said pawl-associated lever upon proper mounting of said control mechanism section to said second wing portion of the base plate;

a locking-unlocking lever pivotally disposed in said second recess and having a guide pin fixed thereto; and an elongate sub-lever having at one end portion an elongate guide slot into which said guide pin of the locking-unlocking lever is slidably inserted and at the other end a circular opening into which said guide pin of said pulley-associated lever is pivotally received, said sub-lever having fourth and fifth work ends, said fourth work end being engageable with said pawl-associated lever upon proper mounting of said control mechanism section to said second wing portion, said fifth work end being engageable with said second end of said cancelling lever upon rotation of the latter in a certain direction.

26. A door latch device as claimed in claim 1, in which said latch mechanism section comprises:

a housing securely mounted on said first wing portion and having a striker receiving recess into which said striker is insertable;

a latch plate pivotally mounted in said housing for latching said striker;

a pawl member pivotally arranged near said latch plate to permit the same to selectively assume full-latched, half-latched and unlatched positions; and a pawl-associated lever connected to said pawl member to rotate therewith, said pawl-associated lever being exposed to the inboard side of said L-shaped base plate so that, upon proper mounting of said control mechanism section to said second wing portion, the lever is brought into operative connection with essential parts of said control mechanism section.

27. A door latch device, comprising:

a generally L-shaped base plate having first and second wing portions;

a latch mechanism unit secured to said first wing portion and including a latch plate which is adapted to engage with a striker to establish a latched connection therebetween;

a control mechanism unit for controlling operation of said latch mechanism unit, said control mechanism unit being mounted to said second wing portion of the base plate;

hinge means detachably and pivotally connecting said control mechanism unit to said latch mechanism unit in a manner to allow said control mechanism unit to pivot to said second wing portion of the base plate; and snap fastening means for detachably fastening said control mechanism unit to said second wing portion in a snap action manner when said control mechanism unit is pivoted to said second wing portion.

* * * * *